United States Patent [19]

Combeau

[11] 4,434,714

[45] Mar. 6, 1984

[54] APPARATUS FOR SCREEN PRINTING BOTTLES

[76] Inventor: Guy Combeau, Le Moulin de la Mie, Saint-Priest sous Aixe, 87700 Aixe sur Vienne, France

[21] Appl. No.: 354,624

[22] Filed: Mar. 4, 1982

[30] Foreign Application Priority Data

Mar. 4, 1981 [FR] France ..... 81 04370
Mar. 4, 1981 [FR] France ..... 81 04371

[51] Int. Cl.[3] ..... B41F 17/22
[52] U.S. Cl. ..... 101/38 A; 101/126
[58] Field of Search ..... 101/126, 38 A, 38 R, 101/39, 40

[56] References Cited

U.S. PATENT DOCUMENTS

| | | | |
|---|---|---|---|
| 2,925,030 | 2/1960 | Johnson | 101/38 A |
| 3,338,574 | 8/1967 | Rudolph et al. | 269/86 |
| 3,933,091 | 1/1976 | Von Saspe | 101/40 |

FOREIGN PATENT DOCUMENTS

| | | | |
|---|---|---|---|
| 2151431 | 4/1973 | Fed. Rep. of Germany . | |
| 2739987 | 3/1978 | Fed. Rep. of Germany . | |
| 1263239 | 5/1961 | France . | |
| 1497680 | 9/1967 | France . | |
| 2186887 | 11/1974 | France . | |
| 300617 | 10/1954 | Switzerland | 101/38 R |
| 416263 | 8/1974 | U.S.S.R. | 101/126 |

*Primary Examiner*—Clifford D. Crowder
*Attorney, Agent, or Firm*—McGiew and Tuttle

[57] ABSTRACT

A serigraphy printing assembly for bottles comprises a conveyor having at least a portion situated between a bottle-picking up station and the entrance to a drying station, and lying in a vertical plane along which the bottles are held so that their longitudinal axis is substantially horizontal and so that they are moved in parallel. A printing station is situated at right angles to the outermost front part of the conveyor portion so that the assembly is kept as narrow as possible and free access is provided to the printing station.

16 Claims, 13 Drawing Figures

Fig. 4
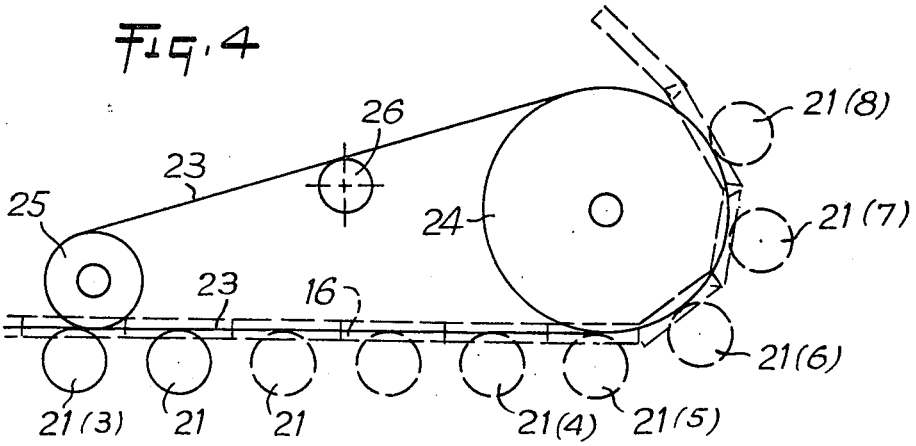
Fig. 5
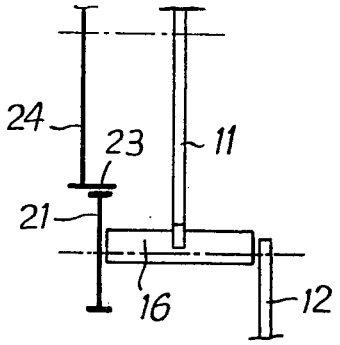
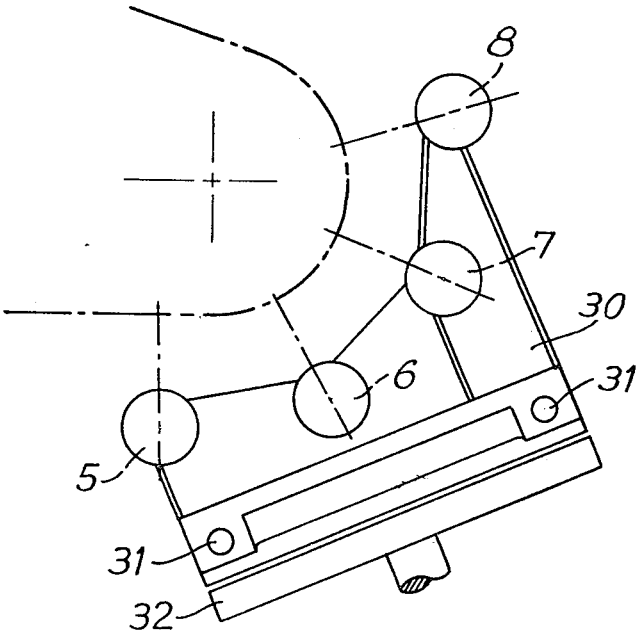
Fig. 6

Fig. 8
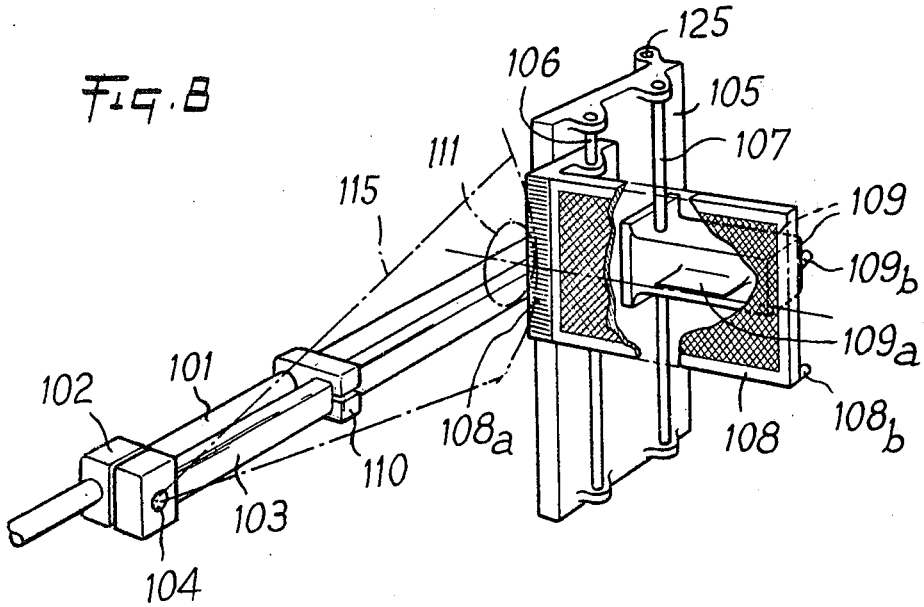
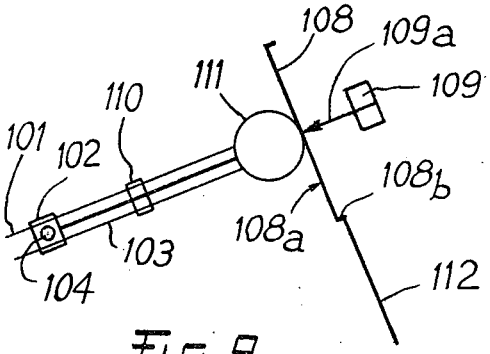
Fig. 9
Fig. 10
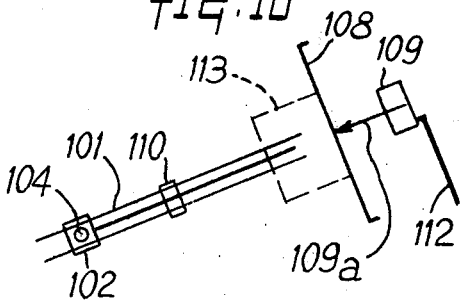
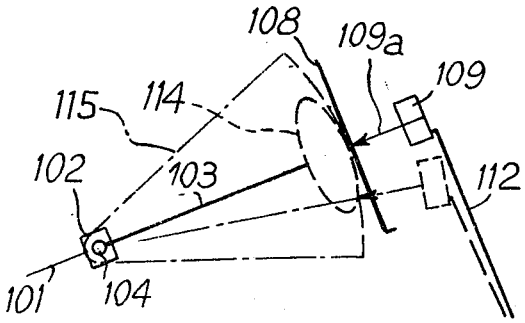
Fig. 11

APPARATUS FOR SCREEN PRINTING BOTTLES

FIELD AND BACKGROUND OF THE INVENTION

Up to the present time, the decorating or marking of plastic bottles has mostly be done in only one color. Serigraphy has been found to be an appropriate and economical solution for this type of printing since it gives a clear printing with a contrasting effect, and since it has proven to be resistant to the products contained in the bottles as well as to wear due to friction during transport, and this with low-cost printing equipment which is easily adaptable to any type of surface and requires little if any training on the part of the operators.

However, these types of bottles having become more than containers, but also trademarks, symbols, or even means for commercial advertizing, it has now become necessary to print them in more than one color for composing ever more complex designs. The machines have therefore had to be specialized, for producing a predetermined decoration on a special design of bottle, in order to meet these demands. This has obliged printers to acquire machines of different types for printing different types of bottles, which has meant high investment costs that often are not recovered due to the instability of the market. In any case, no printing method, serigraphy included, has offered a satisfactory solution to the problem arising from those printing demands. There only remains the use of labels, decalcomania, or transfers under heat, all of which have proven to be rather expensive due to their developing process, their application to the bottle, their lack of versatility in adapting to different types of bottles and the difficulty in obtaining a good resistance to the contents of the bottle.

SUMMARY OF THE INVENTION

It is the aim of the present invention to propose a solution whereby a serigraphy machine can be substituted for the aforesaid labelling and other printing transfer systems.

It is recalled that in this particular field, there exist two large types of machines: the linear machines and the rotary machines. The linear machines are defined by the bottle following a straight path through a succession of stations anely for: printing preparations (dust-removing, positioning, etc.); drying; printing again (for a second color); and drying; etc. Such an installation is cumbersome as amongst other factors, the inks which are used are slow to dry, this defining for a given output rate, the drying time after each printing. It is then necessary to have on hand several persons for watching the machines and intervening when the machines work in polychromy. In a variant, the ink has been changed to obtain a quicker drying, and this has reduced the volume, but not enough to substantially reduce the staff in attendance, while losing in printing quality.

As to rotary machines, these use a horizontal or vertical plate which is rotatable stepwise in order to present the bottles in front of the different processing and printing stations. These machines require a quick-drying ink (through flame of by U.V. polymerization) in order to have three printing stations—therefore three colors maximum—over an acceptable radius. Also, considering for example the complexity of the equipment used for gripping the bottles, these machines are limited to printing only one type of bottle. This type is generally cylindrical because, although it is possible to pass, through these machines, bottles of oval cross-section, the control operations are such that economically, it would be impossible to make such a switch-over. Moreover, the monitoring and control of the different stations of the machine are difficult because of their circular distribution and cannot be assumed by only one person. Finally, the inks used show disadvantages in their covering nature, or their superimposing ability. Generally speaking, a special kind of ink is used in this type of machine which cannot be changed.

It is the aim of the present invention to overcome all these disadvantages by proposing a machine which is designed to eliminate all the aforesaid restrictions concerning the possible choice of ink, the shape of the bottles to be printed, the number of colors applicable, etc. Furthermore, the machine according to the present invention is made up of modules which are easily connectable one to the other, and which can be the responsibility of only one operator.

The object of the invention to this effect is therefore to provide a serigraphy printing assembly for bottles or the like, which comprises means for conveying the bottles step-by-step from a station where a bottle to be printed is picked up, through to a station where the printed bottle is discharged, having successively gone through at least a station where the bottle receives a first treatment, a printing station comprising a printing head, and a drying station, the portion of the assembly between the bottle picking-up station and the entrance to the drying station being in a vertical plane along which the bottles are held so that their longitudinal axis is substantially horizontal and so that they are moved in parallel. According to one feature of the invention, the printing station is situated at right angles to the outermost front part of the abovementioned assembly portion, whereas downstream of this portion, the conveying means passes through an enclosure which is length adjustable in relation to the ink-drying time, the enclosure constituting the drying station mentioned hereinabove.

According to a first embodiment of the invention, the conveying means are provided, at least over the mentioned assembly portion, with clamping members for holding the bottles, which clamping members cooperate with the bottle necks during their transport from one station to another.

More specifically, each of the clamping members is constituted by two arms pivotally mounted on a baseplate forming a link in a conveyor chain. Each arm is coupled in rotation about its hinge connection to the other arm by means of pinions, one of which is integral with a wheel controlling the opening of the clamp cooperating with a chain disposed between the bottle-picking up station and the entrance to the drying station, along the conveyor chain and imparted with a movement which is identical to the conveying movement and with a relative movement of translation with respect to the main movement through which the control wheel is driven in rotation.

It is moreover advantageous to provide, in the machine according to the invention, a special printing head comprising in known manner a bottle support and a support for a screen and for a scraper-holder movable with respect to the screen. The supports are disposed one with respect to the other so that the plane of the screen is kept substantially parallel to the longitudinal axis of the bottle, but in which printing head the support for the screen and scraper-holder is constituted by an arm, one end of which is provided with a plate adjustable in position along the arm. A first slide bar which is perpendicular to the axis of the bottle and parallel to the screen plane, is provided on which slide bar is slidably mounted the screen, and a second slide bar is provided which is parallel to the first and on which is slidably mounted the scraper-holder. The other end of the arm is pivotally mounted on a part adjustable in position along a fixed guide oriented perpendicularly to the surface of the bottle to be printed and traversing the longitudinal axis thereof, the pivoting axis of the other end being parallel to the longitudinal axis of the bottle and situated beyond the surface with respect to the screen. The screen is provided with a rack parallel to the first slide bar.

In the case of printing a cylindrical bottle, the bottle support will be equipped with a chuck for driving the bottle in rotation about its longitudinal axis, the chuck being integral with a pinion adapted to cooperate with the rack.

In the case of printing a bottle of which the face to be printed is a portion of a circle which for example comes into the constitution of an envelope of oval cross-section, the hinge element is provided with a toothed sector of radius equal to the radius of the cylinder portion adapted to cooperate with the rack.

It will be noted that, in removable manner, the arm can be locked in position on the guide, in parallel to the latter, and the screen can be locked in position on the plate, as well as the scraper-holder.

The combined control of the screen, the scraper and the bottle will be ensured by a driving spindle which moves within a plane substantially perpendicular to the arm.

BRIEF DESCRIPTION OF THE DRAWINGS

The invention will be more readily understood on reading the following description with reference to the accompanying drawings, in which:

FIGS. 4 and 5 diagrammatically illustrate the mechanism for controlling the opening and closing of the clamps;

FIGS. 6 and 7 are diagrammatical views of the different stations for treatment, positioning and printing, according to the invention;

FIG. 8 is a diagrammatical perspective view of a printing head according to the invention;

FIGS. 9, 10 and 11 diagrammatically illustrate the different possible adaptations of the printing head according to the invention, to the different shapes of bottles.

DESCRIPTION OF THE PREFERRED EMBOIDMENTS

Figure 1:
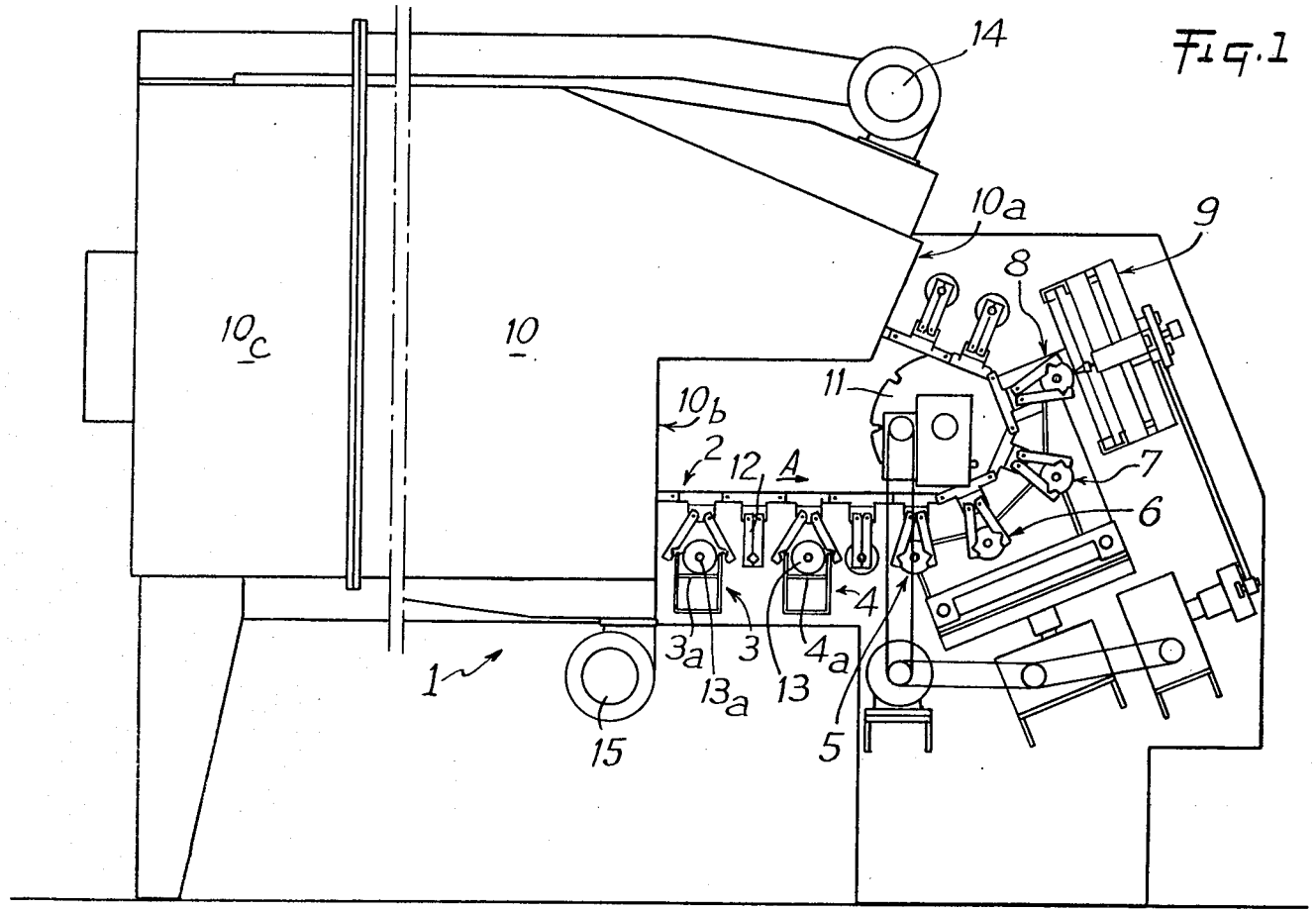
FIG. 1 is an overall elevational side view of a printing assembly according to the invention.

Referring first to FIG. 1, a printing assembly according to the invention is shown which is constituted by a frame 1, supporting the various fixed or movable elements described hereinafter. In frame, a conveying device 2 is disposed so as to turn in the direction of arrow A. The visible part of this device, such as illustrated in the figure, passes in front of a discharge station 3—comprising for example a belt conveyor 3*a* for discharging the bottles—a picking-up station 4—also with a belt conveyor 4*a*—three stations 5, 6 and 7 where the bottle is prepared prior to being printed, by for example a surface treatment in 5, a dust-removing treatment in 6 and pre-positioning in 7—a printing station 8, with final positioning, before which is placed a mechanism 9 carrying the serigraphic screen, the scraper, the ink reserve and means for controlling these different elements, and finally, in the entrance 10*a*, a drying station 10 constituted by a caisson and of which the outlet 10*b* is situated close to the discharge station 3.

It is shown in FIG. 1 that the portion of the device serving the stations 4 to 8 is situated in a substantially vertical plane and the printing station 8 is situated at the end point (or in the immediate vicinity thereof), so that the serigraphy printing mechanism 9 presents itself frontally at the front of the machine. One of the major consequences of this design resides in the small width of the assembly according to the invention and in the great accessibility of the printing station from the outside. By way of indication, it will be noted that the machine width is on the order of 50 cm, this permitting a juxtaposition of several assemblies according to the invention over a very short front (six printing stations or six colors over 3 meters), which can be monitored and controlled easily by only one operator.

In the case illustrated in FIG. 1, the conveying member 2 is constituted by a chain winding round a vertical driving wheel 11, the wound part of the chain forming the front part of the conveyor and machine. The chain may be replaced by any other means capable of conveying articles as far as station 8 (for example a disc provided on its periphery with means for gripping the bottles), while the circulation inside the drying unit of the printed bottles can be ensured by a taking-over conveyor, different from the afore-mentioned device. It may however be advantageous to provide a single conveyor for the whole assembly, which is constituted by an endless chain provided with clamp-shaped gripping means 12—the composition and working of which will be described hereinafter—all of which are in a vertical plane in order to hold the bottles 13 by their necks 13*a*, or any other end part, in a position such that their longitudinal axis is substantially horizontal (perpendicular to the plane of the figure) and to move them in a line parallel to themselves. It is not departing from the scope of the invention to put in a single conveyor serving consecutively several printing assemblies placed one next to the other. It is indeed conceivable for the chain 2, coming from the printing station into the drying enclosure, to be judiciously sent back to a second assembly where it would be oriented vertically, opposite the treatment and printing stations of that second assembly and where it would follow an identical path through the following assemblies, in order, in the end, to discharge the bottles and be sent back empty to the picking up station 4 of the first assembly. This would procure then a continuous chain serving several assemblies operating synchronously from a single source of movement.

It will finally be noted that the drying enclosure 10 of each assembly can receive a plurality of equipments selected in relation to the inks used. For example, using blowers such as 14, 15, it is possible to create a flow of hot (or cold) air. Infrared or U.V. ray generators can be used in replacement, this type of drying or in addition thereto to meet the drying requirements dictated by the nature of the inks or the different mixtures used. It is thus possible for the assembly according to the invention to become so adaptable that different inks can be used which are adapted to the object, or, for the same object, different inks for producing the same decoration.

As regards the drying enclosure 10, it should be noted that this is closed by a rear portion 10c which may be removably fitted on the main part 10. The length of the rear portion can then be selected in relation to the ink drying time and therefore be shorter or longer depending on whether this time is shorter or longer.

Figure 7:
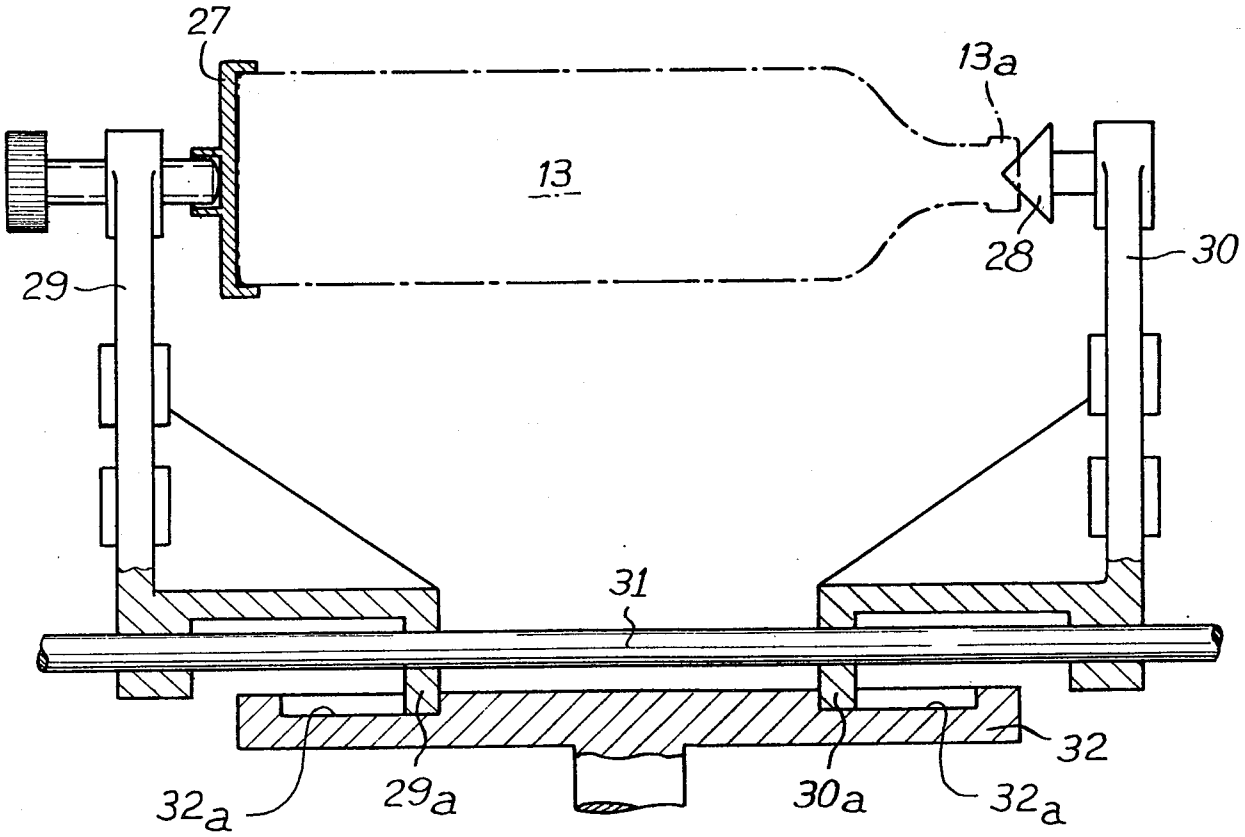

In the case where a drying by infrared or U.V. rays is required, the rear portion can be provided with a device for taking over the bottles brought into the enclosure by the conveyor, which works on the same principle as the device comprising the aforesaid stations 5, 6, 7—described in more detail in reference to FIGS. 5 and 7—which taking-over device permits rotation of the bottles in front of the sources emitting the aforesaid rays. The opening and closing of the clamps 12 for releasing and picking up the bottles opposite the drying station can be controlled by a device similar to that described hereinafter with reference to FIGS. 4 and 5.

Figure 2:
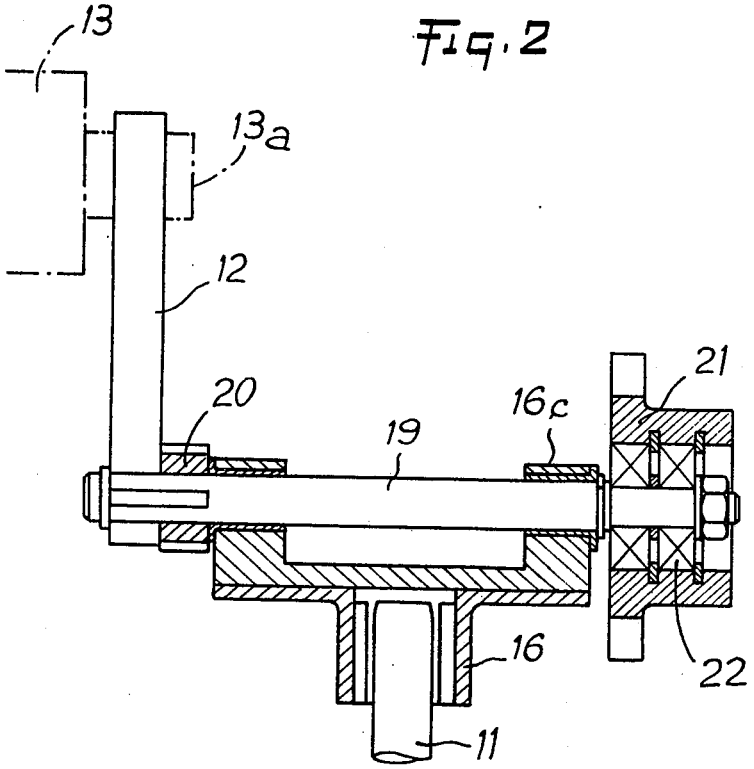
FIGS. 2 and 3 diagrammatically illustrate one embodiment of the conveying clamps according to the invention.
Figure 3:
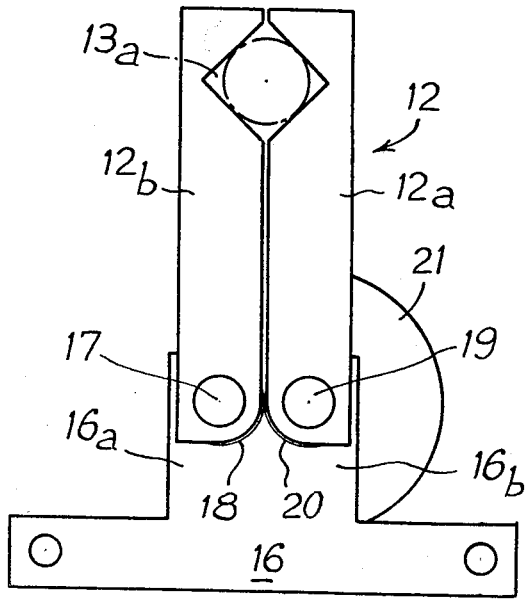

FIGS. 2 and 3 show a link 16 of the endless conveyor chain provided with two arms 12a and 12b forming the clamp 12 adapted to be closed over the neck 13a of a bottle 13. One of the arms 12b is journalled at 17 in a bearing 16a and is fast with a pinion 18 which is likewise centered on the axle 17. The other, 12a, is fast in rotation with a shaft 19 on which is keyed a pinion 20 meshing with the pinion 18, the shaft 19 being supported by two bearings 16b and 16c and comprising at its end opposite the arm 12a a toothed wheel 21 controlling the rotation of the shaft 19. The toothed wheel 21 may be fast in rotation with the shaft 19 or be coupled thereto by way of a free wheel symbolized at 22.

FIG. 4 and FIG. 5 diagrammatically symbolize a control of the opening of the clamps 12. The wheels 21 of the links 16 are shown with index numbers corresponding to the references of the stations defined with reference to FIG. 1. An endless chain 23 is shown which winds over two wheels 24 and 25 placed such that an end of the chain cooperates with the wheels 21 situated between station 3 and station 8. A belt driving member 26 is shown as a pinion coupled to a driving member not shown. Assuming that the wheels 21 are coupled to the shaft 19 by means of a free wheel, the chain 23 is stationary through the step-by-step movement of the conveyor 2. The wheels 21 therefore turn about the axle 19. When the conveyor stops, the chain 23 is imparted with a movement of predetermined amplitude in one direction, by the member 26 (which may be a lever actuating the wheel 24), this movement causing the rotation of the wheels 21 and of the shaft 19. All the clamps open by the movement of the pinions 18 and 20. A reverse movement of similar amplitude closes the clamps (helped by a spring which tends to bring the arms 12a and 12b together). Assuming that the wheel 21 of each clamp is directly wedged in rotation on the shaft 19, provisions will have been made for the chain 23 to be actuated with a movement identical to that of the conveyor 2. In this case, the wheel 24 will be coupled to the shaft driving the toothed wheel 11. When the conveyor has stopped, the member 26 will act on the chain 23 the wheel having been made idle with respect to the wheel 11 to operate the opening and closing of the clamps 12.

Other variants may be brought to these control systems. For example, to obtain, at right angles with the picking-up 4 and discharge 3 stations, an opening angle which is greater than that of the other stations, it is possible to fit in, in the case of a free-wheel coupling of the wheel 21 to the shaft 19, a secondary chain of which the driving will be performed by the chain 23 limited to the remaining stations by way of an amplitude-reducing member (a set of toothed wheels for example).

Finally, FIGS. 6 and 7 diagrammatically show the disposition of the actual means of the assembly according to the invention, which means constitute the members for picking up the bottles at the treatment and printing stations.

The elements already described hereinabove, are also found in these figures with the same reference numbers. At stations 5, 6, 7, 8, and bottles 13 are picked up between the bottom-clamping chucks 27 and pointed parts 28 cooperating with the necks 13a (only the pointed parts and the chucks of station 8 are shown in FIG. 7). These chucks are carried by a substantially vertical plate 29, whereas the pointed parts are carried by a plate 30 which is parallel to the plate 29. The plates are mounted for sliding on fixed bars 31 and are respectively provided with a lower extension 29a and 30a which is engaged in a groove 32a provided in a disc 32 and of which the profile is such that a rotation of the disc causes the bringing closer together or setting apart of the plates 29 and 30 by a predetermined amplitude. The disc 32 is driven in rotation by a member (not shown), which is controlled by the operation of the conveyor 2 (with the necessary timings to avoid interferences). For example, at each step, the clamps 12 place the bottles 13 between the plates 29 and 30. The plates are brought closer together to hold the bottles while the clamps are controlled to open. Some of the chucks are driven in rotation either directly, for example for dust-removing and flame treatment (stations 5 and 6) and over a predetermined angle for pre-positioning (station 7), in known manner, or in relation to the displacement of another member (such as at the printing station where a translation of the serigraphy screen 9 entails a simultaneous rotation of the chuck in the case of a cylindrical container).

The printing assembly according to the invention shows, by its simple design, great possibilities of adaptation where the shape of the bottles to be treated, the inks to be used and the colors to be set, are concerned. Its modular nature enables a rapid passing to the application of a different number of colors on the same bottle. The relative disposition of the bottle conveying means enables the regrouping of all the driving members into one single assembly and the coupling, at will, of the following assemblies which may be, by their frame, mounted on runways in order to place them rapidly in or out of service. Moreover, it will be recalled that the short length of the front where the treating operations are conducted, makes it a machine which is simple for only one operator to control and to check, the operator being capable of intervening at the slightest incident.

In the case of a machine having a set of assemblies placed one next to the other for printing in several runs and several colors, the bottle picking-up members of the assemblies following the first, comprise stations 5 to 7 which are not affected. It is indeed no longer necessary at this stage to carry out a second surface-treatment, or dust-removing or pre-positioning of the bottle. It becomes then advantageous to use these free stations to carry out other functions such as gluing of labels, rotating by a fraction of a turn, or controlling the tightness of the bottles or the "bar code" which may have been applied beforehand on the bottle. It is recalled that the "bar code" is the designation which has now become usual for identifying the bottle and its contents by means of a succession of bars of variable thickness and at variable intervals which can be read out by optical heads connected to computer processing units.

It should finally be specified that one of the special advantages of the assembly according to the invention resides in the principle of the transfer of the bottles and in the means used for this transfer during which the bottles are kept in a specific orientation, this permitting, always, the picking up and releasing of the bottle in very specific positions, which greatly facilitates the succession of the treatments to be undergone by the bottles while simplifying the picking-up systems.

The advantages of the invention indicated hereinafter are greatly increased when using a special printing head such as that illustrated in FIGS. 8 to 13.

Referring first to FIG. 8, this shows a fixed support 101 which belongs to a structure (not shown) of a serigraphy machine. The support 101 constitutes a guide for a hinge part 102 which can be locked in any position on the guide 101. The part 102 supports the end of an arm 103 which can move inside a plane substantially parallel to the guide 101 about the pivoting axis 104, the orientation of which is parallel to the longitudinal axis of the object to be printed (and not shown in this Figure). At one end opposite the hinge part, the arm 103 is equipped with a plate 105, which is adjustable in position along the arm, and comprises two slide bars 106 and 107. The first slide bar 106 constitutes a guide for a serigraphy screen 108. The orientation of this screen is such that it is parallel to the axle 104 (hence to the longitudinal axis of the object to be printed) and perpendicular to the arm 103. More specifically, the screen is kept parallel to the surface to be printed which, if it is cylindrical, is parallel to the axle 104, but which can also show a slight conicity on the axle 104. The screen is secured by means permitting the adjustment of its position in relation to such conicity. Its displacement along the slide bar 106 is perpendicular to the arm 103, and it may be locked in position with respect to the slide bar 106 on the plate 105.

A scraper holder 109 provided with the scraper **109*a* is adapted to slide over the slide bar 107 which is parallel to the slide bar 106, the edge of the scraper 109*a* being thus able to move in parallel to the screen 108 by rubbing against it. Like the screen, the scraper-holder 109 can be locked in position on the plate 105**.

It will also be noted from FIG. 8 that a member 110 is provided which permits the removably locking of arm 103 with respect to the guide slide 101. Also, at **108*a*, there is shown a rack carried by the screen 108, inside the plane thereof and parallel to the first slide bar 106. Finally, the members 108*b* and 109*b* integral with, respectively, the screen 108 and the scraper-support 109, constitute removable attachment means for a drive spindle (not shown), driving the screen and scraper-holder, along their respective slide bar, and if the members are locked in position on the driving plate, of the plate proper in angular oscillation about the said axle 104**.

The diagrams shown in FIGS. 9 to 11 illustrate the different kinematics possible for the means described with reference to FIG. 8. These diagrams show some of those means with the same reference numbers.

FIG. 9 illustrates the case where the bottle is cylindrical. The bottle is held, normally, by means of a support comprising a chuck on the side of the bottom of the bottle, and on the other side, a pointed part which cooperates with the mouth of the bottle, in parallel to the screen 108 which it touches with one of its generating lines. The chuck is coupled in rotation with a pinion having the same diameter as the bottle. The pinion, referenced as 111 in FIG. 9 cooperates with the rack **108*a* of the screen. To conduct the printing operation on the cylindrical bottle. The arm 103 is fixed on the guide 101 by the fastening element 110. The plate 105 already adjusted along the arm 103 is therefore locked in position. The scraper-holder 109 is then fixed on the plate 105 so that the scraper 109*a* is placed along the contact line between the screen and the bottle. With the spindle 112, the head of which is coupled at 108*b* to the screen whereas the foot is hinged on a driving device (not shown), of the eccentric crankpin type or the like. The screen is moved by being pulled down along its slide bar 106. Owing to the engagement of the rack 108*a* into the pinion 111, the bottle rolls without sliding with respect to the screen and the portion of cylinder swept by the scraper 109*a* is printed. The screen is then moved away from the bottle along the guide 101** and the bottle is removed by appropriate means making room for the next one.

FIG. 10 shows the bottle 113 to be printed as being of rectangular cross-section. The bottle therefore has at least one plane surface for printing on. The arm 103 having been locked in position on the guide 101—therefore the plate 105 being fixed—and the screen 108 being fixed in position on the plate, the spindle 112 is connected to the scraper-holder 109. The screen is brought over the plane surface to be printed and the scraper is moved down along the slide bar 107 by means of the spindle 112 to achieve the transfer of the ink carried by the screen on to the bottle surface through the pores of the screen. As in FIG. 9, the screen is then moved away from the object in order to remove the latter. At the same time, the scraper **109*a*** is returned to the top of the screen. The support of the bottle comprises in known manner, means for directing the surface to be printed in parallel to the screen.

FIG. 11 finally illustrates the case of printing on a bottle 114 of relatively flattened section (substantially oval), one of the faces of which may be compared to a portion of cylinder of large radius of curvature. To print that face, which is situated in a specific space with respect to the guide 101, since the bottle-support places the bottle in a fixed position with respect to the supporting structure of the guide 101, the length of the arm 103 is adjusted first by sliding the hinge part 102 over the guide and second by adjusting the position of the plate 105 along the end of the arm 103 so that the screen 108 is separated from the axle 104 by a distance equal to the radius of curvature of the bottle surface. Then a toothed sector 115 is placed and locked in position on the guide 101 (for example on a non-rotating part of the hinge 102 or of the axle 104) the radius of which is also equal to the radius of curvature of the bottle face and on which engages the rack **108*a* of the screen 108. The latter is left free to slide on the slide bar 106 whereas the scraper-holder 109 is immobilized on the plate 105 which is free with respect to the guide 101 as the arm 103 is not secured to the guide. The spindle 112 is coupled to the scraper-holder and when the spindle 112 is pulled down, the whole assembly consisting of the plate 105, the scraper-holder 109 and the arm 103 is driven in rotation about the axle 104. In this movement, the rack 108***a* rolls without slipping over the selector 115, and the screen over the bottle 114. The position of the scraper 109*a* having been adjusted so that the scraper is situated vertically to the contact generatrix between the screen and the bottle, the ink is transferred correctly.

Figure 12:
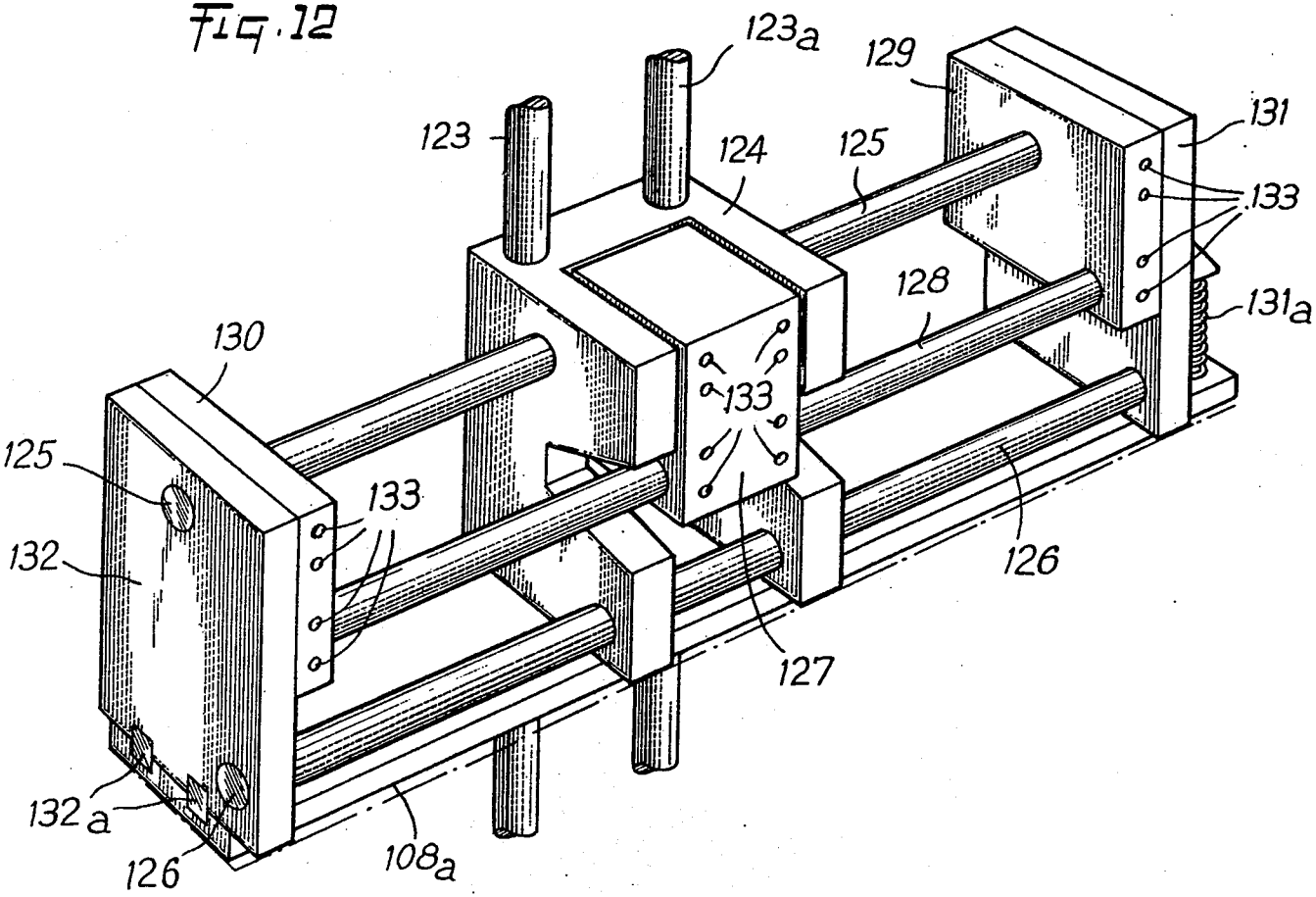
FIGS. 12 and 13 are respectively, a diagrammatical perspective and an elevational view of an industrial embodiment of the invention.
Figure 13:
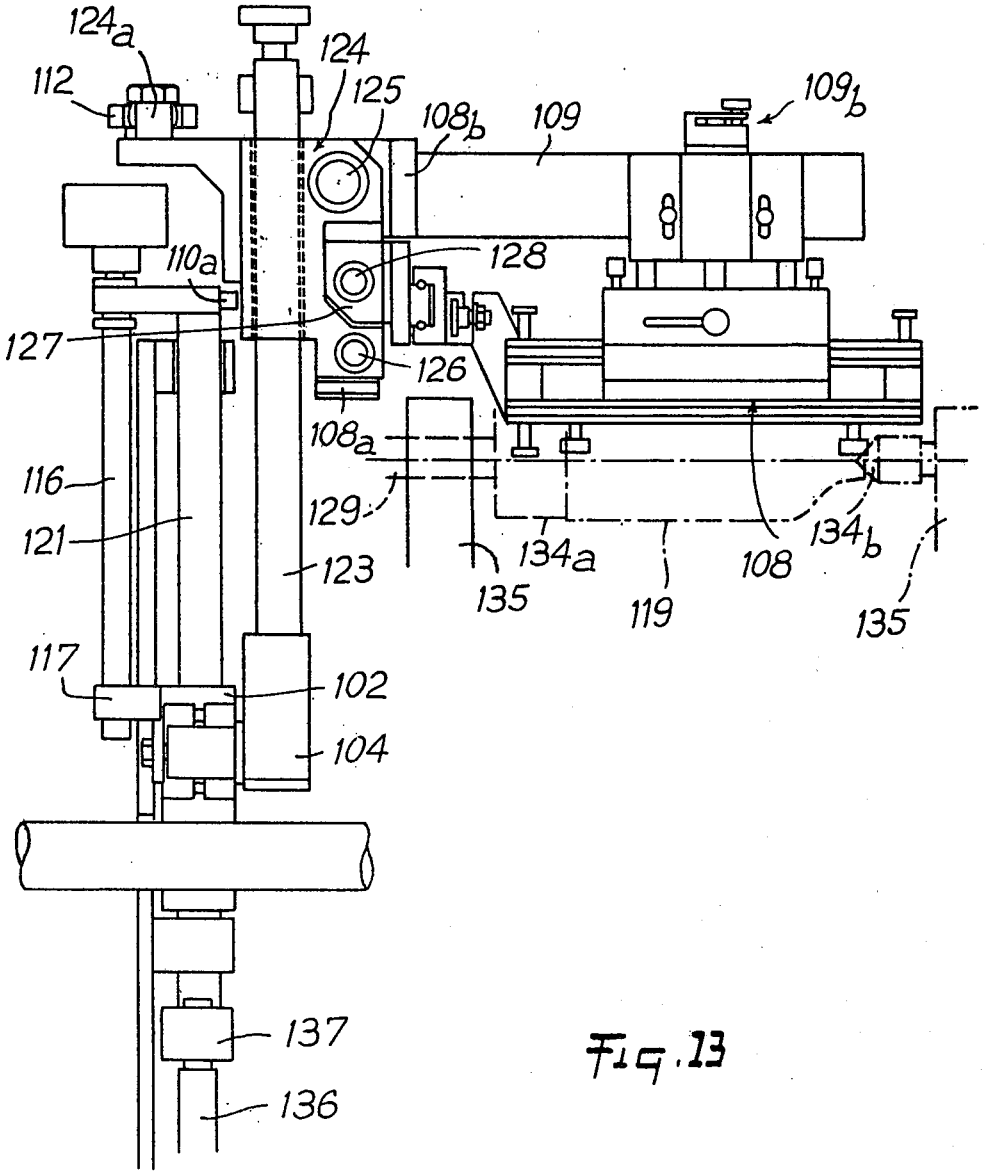

It is clear that the means according to the invention are extremely simple to work and to control and it is possible due to their design to go rapidly from one type of bottle to another. FIGS. 12 and 13 illustrate in the form of a perspective diagram and of an elevational view respectively, an industrial embodiment of the invention. The adjustment of the part 102 along the guide 101 (constituted by a set of parallel columns of which one only 121 is visible in FIG. 13) is achieved by means of a screw 116 and nut 117 system, the latter being coupled to the part 102, and the screw 116 being integral with the columns 121. The arm 103 is also constituted by a set of two columns 123, 123*a*. The plate and slide bars assembly shown in the preceding Figures is disposed differently in the present two Figures, although they have the same functions. For example, a part 124, integral with the columns 123, 123*a* and adjustable along the columns, receives, for transversal sliding, two bars 125 and 126. The piece 124 is fork-shaped to receive a central unit 127 which is also traversed by the bar 125 and receives, for sliding, a bar 128. Bars 125 and 128 are connected together by their ends by way of plates 129 and 130. Bars 125 and 126 are connected in the same way by plates 131 and 132. The front faces of the unit 127 and of the plates 129 and 130 are provided with members 133 to allow the selective fastening of the screen 108 and of the scraper-holder 109 to the assembly. To this effect, the screen 108 and the scraper-holder 109 will be provided with securing sole-plates 108*a* and 108*b* which may be screwed either on the unit 127 or on the plates 129 and 130.

If the sole-plate 109*b* is secured on the unit 127 and the screen 108 is secured on the plates 129 and 130, the columns 123 and 123*a* being coupled with respect to the columns 121 for example by means of a locking bar 110*a*, the configuration shown in FIG. 9 is obtained if the spindle 112 is secured to one end of the carriage constituted by the bars 125, 126, 128 and the plates 129, 130, 131, 132, and which carries the screen 108. The carriage slides with respect to the scraper in the parts 124 and 127. The rack 108*a* is in fact secured to the carriage.

If the sole-plate 108*b* of the screen is secrued to the unit 127 and the sole plate 109*b* of the scraper-holder is secured to the carriage, the spindle 112 remaining coupled thereto, we obtain the configuration shown in FIG. 10, the scraper being moved relatively with respect to the screen which has been locked in position with respect to the guide 101 (columns 121).

Finally, by fixing the scraper-holder to the unit 127 and the screen to the plates 129 and 130 (i.e. to the carriage), and on the contrary by securing the connecting rod to the part 124, we obtain the configuration shown in FIG. 11, the rack 108*a* cooperating with an appropriate stationary toothed sector and the columns 123 and 123*a* being separated from the guide 121.

An advantageous disposition to be noted is that consisting in arranging for the unit 127 and the plates 129 and 130 to be rotatable with respect to the part 124 (and to the plates 131, 132) about the bar 125.

It is thus possible to pivot the screen/scraper assembly about the bar 125 and to have an easy access to the face of the screen in contact with the bottle. The scraper remains always above the screen and there is no ink spilt over. At 124*a* is shown the point where the spindle 112 is secured to the part 124. A similar securing point (not shown) is integral with the carriage at the level of one of the plates 129 to 132. Finally, FIG. 12 shows that the rack 108*a* is coupled to the carriage by elements 132*a* permitting a certain play when the rack is pivoted with respect to the plate 132 or when it is subjected to the effect of a spring 131*a* which opposes its pivoting movement and tends to keep the rack in engagement with the pinion or the toothed sector when the carriage is moved upwardly toward the columns 123, 123*a*.

The bottle 119 shown in FIG. 13 is cylindrical and is held between a chuck 134*a* and a pointed part 134*b* respectively fast with support plates such as 135 belonging for example to a fixed assembly of preparation and bottle position-indexing stations, known per se. This chuck and pointed member are adapted to be moved apart or closer to one another to either grip or release the bottle brought into that spot by any known means. It will be noted that the chuck 134*a* is integral with an axle traversing the plate 135 at the end of which can be fitted a pinion (such as 111 shown in FIG. 9) vertically to the rack 108*a* of the carriage. This pinion can be removed and replaced by the toothed sector 115 of FIG. 11, fixed for example on the pivoting axle 104 which is fixed with respect to the arm 103 (column 123). The pinion and toothed sector have not been shown in the drawing of FIG. 13 for clarity's sake. They can be found in FIG. 8 where they are schematized in chain and dotted lines.

Finally, FIG. 13 shows in 136 a cam which cooperates with a runner 137 carried by one end of the guide 101 (column 121) so as to cause a rising of the head assembly in order that the screen loses contact with the bottle 119. The guide 101 will then be designed for sliding over a support structure and for being kept in permanent contact with the cam 136 by appropriate means. During this movement, the means 132*a* and 131*a* holding the rack 108*a* in position enable the latter to remain in permanent engagement with the pinion or with the toothed sector.

The invention is in no way limited to the description given hereinabove and on the contrary covers any modifications that can be brought thereto without departing from the scope or the spirit thereof. For example, the invention can be applied to any types of bottles, containers, tubes, jars, etc. with or without necks, the clamping of the object being possible on any grippable end portion situated outside the surface to be printed.

What is claimed is:

1. A container printing assembly comprising:

a frame;

conveyor means movably mounted on said frame for conveying a plurality of containers in step-by-step fashion;

a drying station connected to said frame for receiving a rear portion of said conveyor means and formed of an enclosure having an adjustable selected length adapted to a speed of said conveyor for permitting drying of ink applied to the containers, said drying station having an entrance and an exit for said conveyor means;

a discharge station associated with said frame adjacent said drying station enclosure outlet at which containers are discharge from said conveyor means;

a pick-up station associated with said frame adjacent said discharge station at which containers are picked up by conveyor means;

a treatment station associated with said frame adjacent said pick-up station for treatment of containers; and a printing station including a printing head associated with said frame and positioned adjacent a forward end of said conveyor means and adjacent said treatment station and drying station enclosure entrance;

said conveyor means lying in a vertical plane and adapted to hold containers with longitudinal axes of the containers extending substantially horizontally and moving in parallel on said conveyor means;

said conveyor means comprising an endless chain with clamping members for holding each container by cooperation with a neck of each container during transport from one station to another, said endless chain moving entirely in said vertical plane, said conveyor means including a forward chain winding member around which said endless chain is wound at a forward end of said conveyor means;

each of said clamping members comprising a pair of arms each pivotally mounted to a base plate forming a link of said endless chain, a pinion connected to each arm adjacent a pivotal mounting thereof to said base plate and meashed with a pinion of the other arm in each clamping member, a wheel connected to one of said arms for pivoting said one of said arms for opening said clamping members;

a control chain movably mounted on said frame adjacent at least the forward portion of said conveyor means and engageable with each wheel for selectively opening and closing each of said clamping members; and driving means engaged with said control chain for establishing equal and differential movements between said control chain and said conveyor means for opening and closing each of said clamping members.

2. A container printing assembly comprising:

a frame;

conveyor means movably mounted on said frame for conveying a plurality of containers in step-by-step fashion;

a drying station connected to said frame for receiving a rear portion of said conveyor means and formed of an enclosure having an adjustable selected length adaptable to a speed of said conveyor for permitting drying of ink applied to the containers, said drying station having an entrance and an exit for said conveyor means;

a discharge station associated with said frame adjacent said drying station enclosure outlet at which containers are discharged from said conveyor means;

a pick-up station associated with said frame adjacent said discharge station at which containers are picked up by conveyor means;

a treatment station associated with said frame adjacent said pick-up station for treatment of containers; and a printing station including a printing head associated with said frame and positioned adjacent a forward end of said conveyor means and adjacent said treatment station and drying station enclosure entrance;

said conveyor means lying in a vertical plane and adapted to hold containers with longitudinal axes of the containers extending substantially horizontally and moving in parallel on said conveyor means;

said printing head comprising a container holder, a screen support for supporting a printing screen, and a scraper-holder support movably mounted with respect to said screen support, said supports being disposed one with respect to the other so that a plane of a screen held in said screen support is kept substantially parallel to a longitudinal axis of a container held by said container support, each of said screen and scraper-holder supports comprising an arm, one end of which is provided with a plate adjustable in position along a respective arm and including a first slide bar perpendicular to an axis of a container held by said container support and parallel to the screen plane, a screen held by said screen support being slidably mounted on said first slide bar, and a second slide bar parallel to said first slide bar for slidably receiving said scraper-holder support, a fixed guide connected to said frame, an adjustment part movably mounted on said fixed guide, said fixed guide oriented perpendicularly to a surface of a container held by said container support to be printed by said printing head and transversely to a longitudinal axis of the container, each arm pivotally mounted in an opposite end thereof to said adjustment part with a pivotal axis of the one end of each arm being parallel to a longitudinal axis of the container in the support and situated beyond the container surface with respect to a screen held by said screen support.

3. Printing assembly as claimed in claim 2, wherein the screen is provided with a rack parallel to the first slide bar.

4. Printing assembly as claimed in claim 3, wherein the bottle support is equipped with a chuck for driving the bottle in rotation about its longitudinal axis, the chuck being integral with a pinion adapted to cooperate with the rack.

5. Printing assembly as claimed in claim 3, wherein the said adjustment part carries a toothed sector which is fixed with respect to the arm and adapted to cooperate with the rack.

6. Printing assembly as claimed in claim 2, wherein the arm comprises means for locking it in position on the guide and parallel thereto.

7. Printing assembly as claimed in claim 2, wherein the screen comprises means for locking it in position with respect to the arm.

8. Printing assembly as claimed in claim 2, wherein the scraper-holder comprises means for locking it in position with respect to the arm.

9. Printing assembly as claimed in claim 2, wherein the assembly comprising the scraper-holder and the screen is mounted for pivoting on the end of the arm about a pivoting axle perpendicular to the arm.

10. Printing assembly as claimed in claim 2, wherein the scraper-holder and the screen are provided with a removable attachment means for a drive spindle, substantially perpendicular to the arm.

11. Printing assembly as claimed in claim 2, wherein the plate is constituted by a part which is adjustable in position on the arm and which is traversed by slide bars joined together at their ends to form a carriage, the part and carriage presenting elements for the selective attachment of the screen and of the scraper-holder.

12. Printing assembly as claimed in claim 11, wherein the attachment elements are carried by a portion of said part and by a part of said carriage both of which are respectively hinged on the part and carriage about a slide bar of the carriage which is perpendicular to the arm, thereby permitting the pivoting of the screen/-scraper assembly.

13. A container printing assembly as claimed in claim 2 wherein said conveyor means comprise an endless chain with clamping members for holding each container by cooperation with a neck of each container during transport from one station to another, said endless chain moving entirely in said vertical plane, said conveyor means including a forward chain winding member around which said endless chain is wound at a forward end of said conveyor means;

each of said clamping members comprising a pair of arms each pivotally mounted to a base plate forming a link of said endless chain, a pinion connected to each arm adjacent a pivotal mounting thereof to said base plate and meshed with a pinion of the other arm in each clamping member, a control wheel connected to one of said arms for pivoting said one of said arms for opening said clamping members;

a control chain movably mounted on said frame adjacent at least the forward portion of said conveyor means and engageable with each control wheel for selectively opening and closing each of said clamping members; and driving means engaged with said control chain for establishing equal and differential movements between said control chain and said conveyor means for opening and closing each of said clamping members.

14. Printing unit as claimed in claim 13, wherein the control chain is integral with a driving and locking member which locks it in position with respect to the frame when the conveyor means are moving, and imparts to it a movement of translation of predetermined amplitude when the conveyor means have stopped, the control wheels being coupled to the clamping arms by means of a free-wheel mechanism.

15. Printing assembly as claimed in claim 13 wherein the control chain is coupled to a driving member which is actuated with a movement which is identical to that of the conveyor means and with a secondary movement, when said conveyor means have stopped, which secondary movement drives the control wheel in rotation.

16. Printing assembly as claimed in claim 13, wherein said control chain is adjacent the discharging station situated near the picking-up station.

* * * * *